US006942902B2

(12) United States Patent
Sapper

(10) Patent No.: US 6,942,902 B2
(45) Date of Patent: Sep. 13, 2005

(54) AQUEOUS FUNCTIONAL COATING MATERIAL AND INTEGRATED METHOD FOR PRODUCTION OF COLOURED OR EFFECT-GENERATING MULTI-LAYER COATINGS

(75) Inventor: Ekkehard Sapper, Rimpar (DE)

(73) Assignee: BASF Coatings AG, Munster (DE)

( * ) Notice: Subject to any disclaimer, the term of this patent is extended or adjusted under 35 U.S.C. 154(b) by 29 days.

(21) Appl. No.: 10/474,908

(22) PCT Filed: May 24, 2002

(86) PCT No.: PCT/EP02/05707

§ 371 (c)(1),
(2), (4) Date: Oct. 15, 2003

(87) PCT Pub. No.: WO02/096572

PCT Pub. Date: Dec. 5, 2002

(65) Prior Publication Data

US 2004/0077750 A1 Apr. 22, 2004

(30) Foreign Application Priority Data

May 28, 2001 (DE) ..... 101 24 576

(51) Int. Cl.[7] ..... B05D 3/02; B05D 3/06

(52) U.S. Cl. ..... 427/493; 427/514; 427/519; 427/379; 427/409

(58) Field of Search ..... 427/493, 508, 427/514, 518, 519, 379, 388.1, 388.2, 388.4, 409

(56) References Cited

U.S. PATENT DOCUMENTS

| | | | | |
|---|---|---|---|---|
| 5,368,944 A | | 11/1994 | Hartung et al. | 428/423.1 |
| 6,093,497 A | | 7/2000 | Wiemann et al. | 428/500 |
| 6,221,949 B1 | * | 4/2001 | Gross et al. | 524/451 |
| 6,332,291 B1 | | 12/2001 | Flosbach et al. | 52/91 |
| 6,337,139 B1 | * | 1/2002 | Sapper | 428/524 |
| 6,583,214 B1 | * | 6/2003 | Haeberle et al. | 524/589 |
| 6,602,972 B1 | * | 8/2003 | Schwarte et al. | 528/45 |
| 6,620,511 B1 | | 9/2003 | Wigger et al. | 428/413 |

FOREIGN PATENT DOCUMENTS

| | | |
|---|---|---|
| DE | 19736083 | 2/1999 |
| DE | 19855125 | 5/2000 |
| DE | 19904317 | 8/2000 |
| DE | 19904624 | 8/2000 |
| DE | 19930067 | 1/2001 |
| DE | 19953446 | 5/2001 |
| WO | WO0132729 | 3/2001 |

OTHER PUBLICATIONS

Meisenburg, et al., U.S. Appl. No. 09/485,982, filed Feb. 17, 2000.
Mayer, et al., U.S. Appl. No. 09/856,950, filed May 29, 2001.
Schwarte, et al., U.S. Appl. No. 09/869,257, filed Jun. 26, 2001.
Mayer, et al., U.S. Appl. No. 09/889,647, filed Nov. 7, 2001.
Bremer, et al., U.S. Appl. No. 10/018,703, filed Dec. 13, 2001.
Figge, et al., U.S. Appl. No. 10/111,886, filed Apr. 26, 2002.
Schwarte, et al. U.S. No. 10/130,026, filed May 1, 2002.

* cited by examiner

*Primary Examiner*—Erma Cameron

(57) ABSTRACT

A wet-on-wet process for producing multicoat color and/or effect coating systems is disclosed. The process involves using aqueous functional coating materials comprising (A) at least one crosslinkable binder, (B) at least one separate, water-soluble and/or -dispersible crosslinking system which independently effects partial or complete crosslinking in and/or on the matrix of the wet, drying and/or dried films (2) of the aqueous functional coating materials before the binders (A) crosslink completely; and (C) at least one pigment.

17 Claims, No Drawings

AQUEOUS FUNCTIONAL COATING MATERIAL AND INTEGRATED METHOD FOR PRODUCTION OF COLOURED OR EFFECT-GENERATING MULTI-LAYER COATINGS

CROSS REFERENCE TO RELATED APPLICATIONS

This application is a National Phase Application of Patent Application PCT/EP02/05707 filed on 24 May 2002, which claims priority to DE 101 24 576.9, filed on 28 May 2001.

The present invention relates to a novel integrated wet-on-wet process for producing multicoat color and/or effect coating systems which comprise at least one functional coat and at least one solid-color and/or effect topcoat or alternatively at least one color and/or effect basecoat and at least one clearcoat. The present invention further relates to novel aqueous functional coating materials for producing multicoat color and/or effect coating systems.

By integrated wet-on-wet processes are meant coating processes in which at least two different coating materials are applied in at least two films one above the other(s), the bottom film or films being merely dried but not completely crosslinked, after which the films are cured together.

Integrated wet-on-wet processes for producing multicoat color and/or effect coating systems which comprise at least one functional coat and at least one solid-color and/or effect topcoat or alternatively at least one color and/or effect basecoat and at least one clearcoat are known. These integrated processes comprise (1) applying aqueous functional coating materials to primed or unprimed substrates, and then
(2) drying the resulting films of the aqueous functional coating materials, without fully curing them,
(3) coating the dried films (2) with aqueous basecoat materials, then
(4) coating the resulting aqueous basecoat films (3), without fully curing them, with clearcoat materials, and then
(5) curing the films (2), (3), and (4) together, to give the functional coats, the color and/or effect basecoats, and the clearcoats.

By way of example, refer to the German patent application DE 44 38 504 A1.

The aqueous functional coating materials used in these processes are physically curable and comprise a water-dilutable polyurethane resin binder having an acid number of from 10 to 60 and a number-average molecular weight of from 4000 to 25,000. The polyurethane resin is preparable by reacting with one another aa) a polyester polyol and/or polyether polyol having a number-average molecular weight of from 400 to 5000 or a mixture of such polyester polyols and/or polyether polyols, bb) a polyisocyanate or a mixture of polyisocyanates, cc) a compound containing per molecule at least one isocyanate-reactive group and at least one group capable of forming anions, or a mixture of such compounds, and, if desired, dd) a hydroxyl- and/or amino-containing organic compound having a molecular weight of from 40 to 400, or a mixture of such compounds, and at least partly neutralizing the resulting reaction product. The aqueous functional coating materials further comprise pigments and/or fillers, the ratio of binder to pigment being between 0.5:1 and 1.5:1. They may also include amino resins or polyisocyanates in minor amounts.

The known aqueous functional coating materials permit the production of particularly thin primer-surfacer coats, antistonechip primer coats or functional coats without loss of stonechip resistance or deterioration in the masking of the unevennesses in the primed substrate. The known wet-on-wet process is therefore particularly favorable from both an economic and an environmental standpoint.

A disadvantage is that the known wet-on-wet process is limited to the use of a specific type of polyurethane and in that respect, therefore, offers no alternatives. Despite this, owing to the numerous economic, environmental, and technical advantages afforded by the aqueous functional coating materials known from DE 44 38 504 A1 and the wet-on-wet process they make possible, there is a desire to replace the customary and known, so-called baking primer-surfacers by the aqueous functional coating materials.

This substitution, however, is not readily possible, since in the course of the production of the multicoat color and/or effect coating systems in accordance with DE 44 38 504 A1 there is frequently a shift in the effect and/or shade relative to the multicoat color and/or effect coating systems produced by applying the same aqueous basecoat materials to baked primer-surfacer coats (cf., e.g., the German patent application DE 199 30 552 A1) and curing them thereon. This also prevents the use of the same aqueous basecoat materials in the two processes in one plant.

A further integrated wet-on-wet process is known from the European patent application EP 0 871 552 A1. This known integrated process comprises (A) applying an aqueous basecoat material (ii) comprising an aqueous polymer dispersion as film-forming agent to a substrate surface coated with an aqueous functional coating material (i),
(B) applying a suitable clearcoat material to the film obtained in stage (A), and
(C) baking the film of the aqueous functional coating material (i) and the film of the aqueous basecoat material (ii) together with the clearcoat film, said aqueous basecoat material (ii) comprising an aqueous polymer dispersion comprising (x) a (meth)acrylate copolymer based on from 30 to 60% by weight of $C_1$–$C_8$ alkyl (meth)acrylate monomers, from 30 to 60% by weight of vinylaromatic monomers and from 0.5 to 10% by weight (meth)acrylic acid, and
(y) a nonassociative thickener comprising a (meth)acrylate copolymer based on $C_1$–$C_6$ alkyl (meth)acrylate and (meth)acrylic acid.

The multicoat color and/or effect coating systems produced by these integrated processes can be refinished very effectively, and there is no material restriction on the composition of the functional coating materials (i). However, this is not so for aqueous basecoat materials (ii), which necessarily comprise aqueous dispersions of (meth)acrylate copolymers based on the constituents (x) and (y). Only by this means is it ensured that even clearcoats based on powder slurry clearcoat materials can be used to produce the multicoat systems without any occurrence of mud cracking.

There is therefore a need for a wet-on-wet process which exhibits the advantages of the prior art without displaying its disadvantages and which permits substitution of the baking primer-surfacers, without great material, apparatus and process complexity, and without any occurrence of a shift in effect and/or shade in the aqueous basecoats.

Aqueous functional coating materials comprising at least one ionically and/or nonionically stabilized polyurethane which is saturated, unsaturated and/or grafted with olefinically unsaturated compounds, as binder, and also pigments are known from the German patent applications DE 199 14 896 A1, DE 199 53 445 A1, DE 199 53 203 A1, and DE 199 53 446 A1. They may be cured either thermally or both thermally and with actinic radiation. The thermal cure may be effected by self-crosslinking or external crosslinking.

An object of DE 199 14 896 A1 is to provide novel polyurethane dispersions having very little, if any, tendency to form coagulum.

An object of DE 199 53 446 A1 was to provide novel, olefinically unsaturated hydrophilic or hydrophobic polyurethanes which have a particularly high graft activity and are simple to obtain. A further object thereof was to provide novel graft copolymers based on the novel polyurethanes.

Substantial objects of the patent applications DE 199 53 445 A1 and DE 199 53 203 A1 were to provide aqueous and nonaqueous, self-crosslinking functional coating materials, adhesives, and sealing compounds based on polyurethane and having very good performance properties. The intention was in particular that the self-crosslinking functional coating materials, especially the aqueous self-crosslinking functional coating materials, specifically the self-crosslinking aqueous basecoat materials, should not give rise to any mud cracking or popping marks or pinholes in the course of their processing by the wet-on-wet process, even when using powder clearcoat slurries. These novel functional coating materials are to have very good storage stability, outstanding application properties, such as very good leveling and very little tendency to develop runs, even at high film thicknesses. The multicoat systems produced using them ought to have an outstanding overall visual appearance and also high chemical, yellowing and weathering stability. Not least, there is no longer to be any delamination of the films after the water jet test. All of these advantages ought to be achievable without having to accept any increase in the emission of organic compounds.

The aqueous functional coating materials of DE 199 53 445 A1, DE 199 53 203 A1 or DE 199 53 446 A1 may be used, inter alia, as primer-surfacers. Preferably, however, they are used as aqueous basecoat materials. Whether, and, if so, to what extent the known aqueous functional coating materials as primer-surfacers are capable of substituting customary and known baking primer-surfacers in a wet-on-wet process without any accompanying shift in effect and/or shade. Moreover, the known aqueous functional coating materials do not include a separate, water-soluble and/or -dispersible crosslinking system which independently effects partial or complete crosslinking in and/or on the matrix of wet, drying and/or dried films of the aqueous functional coating materials before the films overall crosslink completely. Nor do the patent applications give any indications which might prompt the skilled worker to add such a system to aqueous functional coating materials.

The German patent applications DE 199 04 317 A1 and DE 198 55 125 A1 disclose aqueous multicomponent systems based on hydroxyl-containing polyurethanes and polyisocyanates. The aqueous multicomponent systems may comprise radiation-curable binders, reactive diluents, and photoinitiators. Accordingly, there are two separate crosslinking systems alongside one another. The aqueous multicomponent systems may also be used as primer-surfacers. However, owing to their high reactivity, the polyurethanes and the polyisocyanates begin to crosslink immediately following the application of the aqueous multicomponent systems, so that curing with actinic radiation cannot be carried out in such a way that it is substantially at an end before the full thermal curing of the matrix of the films. Accordingly, the two crosslinking mechanisms operate in parallel, or curing with actinic radiation is carried after thermal curing.

An object of the German patent application DE 199 04 317 A1 was to provide aqueous multicomponent systems which, especially in the course of prolonged storage, are infested and destroyed by microorganisms to a lesser extent, if at all.

An object of the German patent application DE 198 155 125 A1 was to provide aqueous multicomponent systems which are easy to produce, homogeneous, easy to manage, low in solvent, proof against popping marks and splashes, and stable on forced drying, and which give matt coatings which do not exhibit surface defects or gray haze but instead are stable to weathering and resistant to gasoline.

Accordingly, the skilled worker was unable from these patent applications either to infer any indications to use two different crosslinking systems alongside one another in an aqueous, polyurethane-based primer-surfacer in order to prevent a shift in the effect and/or shade of the aqueous basecoats when substituting conventional baking coatings by the aqueous, polyurethane-based primer-surfacers.

The thermal crosslinking of functional coating materials by the complementary keto groups and hydrazide groups is known per se. The use of these complementary reactive functional groups in aqueous functional coating materials based on polyurethanes is not described in the German patent applications cited above.

It is an object of the present invention to provide a novel wet-on-wet process for producing multicoat color and/or effect coating systems that has the economic, technical and environmental advantages of the process known from the German patent application DE 44 38 504 A1 or the European patent application EP 0 871 552 A1 and makes it possible, without great material, apparatus or process complexity, to substitute baking primer-surfacers without any occurrence of a shift in effect and/or shade in the aqueous basecoats.

A further object of the present invention is to provide a novel aqueous functional coating material which is outstandingly suitable for producing multicoat color and/or effect coating systems and can be used to produce functional coats, primer-surfacer coats, antistonechip primer coats, solid-color topcoats, and basecoats, but especially functional coats. In particular, however, the novel aqueous functional coating material should be suitable for the novel wet-on-wet process.

The invention accordingly provides the novel wet-on-wet process for producing multicoat color and/or effect coating systems which comprise at least one functional coat and at least one solid-color and/or effect topcoat or alternatively at least one color and/or effect basecoat and at least one clearcoat in which process (1) aqueous functional coating materials are applied to primed or unprimed substrates, and then
(2) the resulting films of the aqueous functional coating materials, without being fully cured, are dried,
(3) the dried films (2) of the aqueous functional coating materials are coated with aqueous solid-color topcoat materials, and then
(4) the films (2) and (3) are cured together, to give the functional coats and the solid-color topcoats;

or alternatively (3) the dried films (2) of the aqueous functional coating materials are coated with aqueous basecoat materials, and then
(4) the resulting aqueous basecoat films (3), without being fully cured, are coated with clearcoat materials, and then
(5) the films (2), (3), and (4) are cured together, to give the functional coats, the basecoats, and the clearcoats;

or alternatively (3) the dried films, (2) of the aqueous functional coating materials are coated with aqueous basecoat materials, (3) the resulting aqueous basecoat films (3) and the dried films (2) are cured together, to give the functional coats and the basecoats, and (4) the basecoats are coated with clearcoat materials, and then (5) the clearcoat films (4) are cured, to give the clearcoats;

which comprises using aqueous functional coating materials comprising (A) at least one crosslinkable binder, (B) at least one separate, water-soluble and/or -dispersible crosslinking system which independently effects partial or complete crosslinking in and/or on the matrix of the wet, drying and/or dried films (2) of the aqueous functional coating materials before the binders (A) crosslink completely, and (C) at least one pigment.

In the text below, the novel wet-on-wet process for producing multicoat color and/or effect coating systems is referred to as the "process of the invention".

The invention additionally provides the novel aqueous functional coating materials comprising (A) at least one crosslinkable binder, (B) at least one separate, water-soluble and/or -dispersible crosslinking system which independently effects partial or complete crosslinking in and/or on the matrix of the wet, drying and/or dried films (2) of the aqueous functional coating materials before the binders (A) crosslink completely, and (C) at least one pigment.

In the text below, the novel aqueous functional coating materials are referred to as the "functional coating materials of the invention".

A further subject matter of the invention will emerge from the description.

In the light of the prior art it was surprisingly and unforeseeable for the skilled worker that the object on which the present invention was based might be achieved with the aid of a process of the invention, in particular with the aid of the functional coating materials of the invention. A particular surprise was that the shifts in effect and/or shade of aqueous basecoats that were a frequent occurrence when substituting conventional baking primer-surfacers by aqueous, polyurethane-based functional coating materials could be reduced significantly by adding a separate, water-soluble and/or -dispersible crosslinking system capable independently of effecting partial or complete crosslinking in and/or on the matrix of wet, drying and/or dried films of aqueous functional coating materials before the binders (A) overall crosslink completely. Surprising above all was that the process of the invention and in particular the functional coating materials of the invention gave functional coats which had high stonechip resistance even in film thicknesses unusually low for primer-surfacers. At the same time the novel functional coats exhibited outstanding intercoat adhesion between the primers and the aqueous basecoats.

The process of the invention is used to produce multicoat color and/or effect coating systems on primed or unprimed substrates.

The novel multicoat color and/or effect coating systems comprise at least one functional coat and at least one solid-color and/or effect topcoat or alternatively at least one color and/or effect basecoat and at least one clearcoat.

Functional coats within the meaning of the present invention are primer-surfacer coats within the meaning of the German patent application DE 44 38 504 A1 or of the European patent application DE 0 871 552 A1 which even in unusually low thicknesses exhibit a high stonechip protection effect and in many cases, moreover, contribute to imparting color and/or effect as well.

Suitable substrates are all those whose surface is undamaged by the use of heat and/or actinic radiation in the course of the curing of the films present thereon. Preferably, substrates comprise metals, plastics, wood, ceramic, stone, textile, fiber composites, leather, glass, glass fibers, glass wool and rock wool, mineral- and resin-bound building materials, such as plasterboard and cement slabs or roof tiles, and also composites of these materials.

Accordingly, the process of the invention and the functional coating materials of the invention are suitable not only for application in the fields of automotive OEM finishing and automotive refinish but are also suitable for coating buildings, inside and out, and for coating doors, windows, and furniture, for industrial coating, including coil coating, container coating, and the impregnation and/or coating of electrical components, and also for the coating of white goods, including domestic appliances, boilers, and radiators. In the context of industrial coatings they are suitable for coating virtually all parts and articles for private or industrial use, such as domestic appliances, small metal parts such as nuts and bolts, hubcaps, wheel rims, packaging, or electrical components, such as motor windings or transformer windings.

In the case of electrically conductive substrates it is possible to use primers produced conventionally from electrodeposition coating materials. Both anodic and cathodic electrodeposition coating materials are suitable for this purpose, but especially cathodic electrocoat materials. The substrates may, however, also have a cathodically deposited electrocoat film which is not thermally cured but instead is merely dried or partly cured. The electrocoat or electrocoat film may then be overcoated with the functional coating materials of the invention or with the functional coating materials for use in accordance with the invention. These overcoat films may then be cured together with the electrocoat film (wet-on-wet process).

Examples of suitable cathodic electrodeposition coating materials and, where appropriate, of wet-on-wet processes including electrodeposition coating films are described in the Japanese patent application 1975-142501 (Japanese Laid-Open Specification JP 52-065534 A2, Chemical Abstracts No. 87: 137427) or in the patents U.S. Pat. No. 4,375,498 A1, U.S. Pat. No. 4,537,926 A1, U.S. Pat. No. 4,761,212 A1, EP 0 529 335 A1, DE 41 25 459 A1, EP 0 595 186 A1, EP 0 074 634 A1, EP 0 505 445 A1, DE 42 35 778 A1, EP 0 646 420 A1, EP 0 639 660 A1, EP 0 817 648 A1, DE 195 12 017 C1, EP 0 192 113 A2, DE 41 26 476 A1, and WO 98/07794.

Unfunctionalized and/or apolar plastics surfaces may be subjected prior to coating in a known manner to a pretreatment, such as with a plasma or by flaming, or may be provided with a water-based primer.

In the first step of the process of the invention, at least one, especially one, functional coating material of the invention is applied to a substrate.

The functional coating material of the invention comprises at least one, especially one, binder (A) There is no restriction on the physical composition of the binders (A). Moreover, they may be oligomers or polymers.

Oligomers are resins containing at least 2 to 15 monomer units in their molecule. Polymers are resins containing at least 10 repeating monomer units in their molecule. For further details of these terms, refer to Römpp Lexikon Lacke und Druckfarben, Georg Thieme Verlag, Stuttgart, N.Y., 1998, "oligomers", page 425.

The binders (A) are preferably selected from the group consisting of random, alternating and/or block, linear and/or branched and/or comb addition (co)polymers of ethylenically unsaturated monomers, and polyaddition resins and polycondensation resins, which are crosslinkable or curable physically, thermally, with actinic radiation, or both thermally and with actinic radiation.

For further details of these terms, refer to Römpp Lexikon Lacke und Druckfarben, Georg Thieme Verlag, Stuttgart, N.Y., 1998, page 457, "polyaddition" and "polyaddition resins (polyadducts)", and also pages 463 and 464, "polycondensates", "polycondensation", and "polycondensation resins".

Examples of highly suitable addition (co)polymers (A) are (meth)acrylate copolymers and partially saponified polyvinyl esters, especially (meth)acrylate copolymers.

Examples of highly suitable polyaddition resins and/or polycondensation resins (A) are polyesters, alkyds, polyurethanes, polylactones, polycarbonates, polyethers, epoxy resin-amine adducts, polyureas, polyamides or polyimides.

Of these, the polyurethanes (A) are of advantage and so are used with preference. Particular preference is given to selecting the polyurethanes (A) from the group consisting of ionically or nonionically, and also ionically and nonionically, stabilized polyurethanes which are saturated, unsaturated and/or grafted with olefinically unsaturated compounds.

Polyurethanes (A) are known per se and are described in detail, for example, in

- the German patent application DE 199 14 896 A1, column 1 lines 29 to 49, column 4 line 23 to column 11 line 5, and column 19 line 12 to column 20 line 6,
- the German patent application DE 44 38 504 A1, page 2 line 58 to page 4 line 40 in conjunction with page 5 line 24 to page 7 line 33,
- the German patent application DE 199 04 624 A1, page 2 line 35 to page 5 line 46 in conjunction with page 7 line 36 to page 8 line 14,
- the German patent application DE 41 07 136 A1, page 2 line 23 to page 4 line 35 in conjunction with page 5 lines 23 to 59,
- the German patent application DE 199 04 317 A1, page 9 line 44 to page 12 line 11 in conjunction with page 16 line 58 to page 17 line 2.

For further details, reference is made to the German patent applications cited at the outset.

The amount of binders (A) in the functional coating materials of the invention may vary widely and is guided by the requirements of the individual case. The amount is preferably from 10 to 80, more preferably from 15 to 78, with particular preference from 20 to 76, with very particular preference from 25 to 74, and in particular from 30 to 72, % by weight, based in each case on the solids of the functional coating material.

Functional coating materials of the invention further comprise at least one, especially one, separate, water-soluble and/or -dispersible crosslinking system (B).

In the context of the present invention, the term "separate" emphasizes the fact that the crosslinking system operates independently or substantially independently from the crosslinking of the binder (A). The critical factor here is that the separate crosslinking system (B) independently effects partial or complete crosslinking in and/or on the matrix of the wet, drying and/or dried films of the functional coating materials of the invention before the binders (A), especially the polyurethanes (A), crosslink completely and thereby effect complete crosslinking of the films overall.

The separate crosslinking system (B) for use in accordance with the invention may be of any desired composition provided it meets the condition essential to the invention. In other words, the separate crosslinking system (B) for use in accordance with the invention may be selected with reference to the composition of the aqueous functional coating materials based on the above-described binders (A), especially the polyurethanes (A).

The separate crosslinking system (B) is preferably selected from the group consisting of crosslinking systems curable physically, thermally, with actinic radiation, and both thermally and with actinic radiation.

As actinic radiation it is preferred to use electromagnetic radiation, preferably near infrared (NIR), visible light, UV radiation or X-rays, especially UV radiation, and/or corpuscular radiation, especially electron beams.

The separate crosslinking system (B) is more preferably selected from the group consisting of crosslinking systems curable thermally or both thermally and with actinic radiation. In this case the crosslinking systems (B) may be thermally self-crosslinking and/or externally crosslinking.

In the context of the present invention, the term "physical curing" denotes the curing of the separate crosslinking system (B) for use in accordance with the invention by filming at the surface, for example, of the matrix of the films comprising the functional coating materials of the invention, with linking taking place by looping of the polymer molecules of the binders (regarding the term, cf. Römpp Lexikon Lacke und Druckfarben, Georg Thieme Verlag, Stuttgart, N.Y., 1998, "binders", pages 73 and 74). Or else filming takes place by way of the coalescence of particles of the separate crosslinking system (B) (cf. Römpp Lexikon Lacke und Druckfarben, Georg Thieme Verlag, Stuttgart, N.Y., 1998, "curing", pages 274 and 275). Normally, no crosslinking agents are necessary for this purpose. If desired, the physical curing may be assisted by atmospheric oxygen, by heat, or by exposure to actinic radiation.

The selection of a physically curing separate crosslinking system (B) is guided by the temperature at which the functional coating material of the invention itself forms a film or is thermally crosslinked. The physically curing separate crosslinking systems (B) chosen are those whose minimum film formation temperature (MFFT) (cf. Römpp Lexikon Lacke und Druckfarben, Georg Thieme Verlag, Stuttgart, N.Y., 1998, "minimum film formation temperature", page 391) is below the minimum film formation temperature or the crosslinking temperature of the functional coating materials of the invention and/or the binders (A). The skilled worker will therefore be able to easily determine suitable, physically curing, separate crosslinking systems (B) for a given functional coating material of the invention that cures physically, thermally, or both thermally and with actinic radiation, on the basis of his or her general knowledge of the art, with the assistance of simple preliminary tests where appropriate.

In the context of the present invention the term "self-crosslinking" refers to the capacity of the crosslinking system (B) for use in accordance with the invention to undergo crosslinking reactions "with itself". A prerequisite for this is that at least one constituent already includes both kinds of complementary reactive functional groups that are necessary for crosslinking, or reactive functional groups which are able to react with themselves. Externally crosslinking, in contrast, is a term used to refer to those separate crosslinking systems (B) in which one kind of the complementary reactive functional groups is present in a binder and the other kind is present in a curing or crosslinking agent. For further details of these terms, refer to Römpp Lexikon Lacke und Druckfarben, Georg Thieme Verlag, Stuttgart, N.Y., 1998, "curing", pages 274 to 276), especially bottom of page 275.

Examples of suitable complementary reactive functional groups for use in accordance with the invention are summarized in the following overview. In the overview, the variable R represents an acyclic or cyclic aliphatic radical, an aromatic radical and/or an aromatic-aliphatic (araliphatic) radical; the variables R' and R" represent identical or different aliphatic radicals or are linked with one another to form an aliphatic or heteroaliphatic ring.

Examples of suitable constituents for the separate crosslinking systems (B) for use in accordance with the invention and curable thermally or both thermally and with actinic radiation, the systems comprising the complementary reactive functional groups described above, are described in detail, for example, in the German patent application DE 199 30 067 A1, page 3 lines 23 to 56 in conjunction with page 4 line 23 to page 7 line 19, page 7 line 20, page 9 line 20, page 9 lines 21 to 29, page 9 line 49 to page 11 line 37, page 11 lines 38 to 68, page 12 lines 30 to 55, and page 16 line 50 to page 17 line 13, the German patent application DE 199 14 896 A1, column 11 line 6 to column 13 line 55, Overview: Examples of complementary functional groups

| Binder<br>crosslinking agent | and<br>or<br>and | crosslinking agent<br>binder |
|---|---|---|
| —SH | | —C(O)—OH |
| —$NH_2$ | | —C(O)—O—C(O)— |
| —OH | | —NCO |
| —O—(CO)—NH—(CO)—$NH_2$ | | —NH—C(O)—OR |
| —O—(CO)—$NH_2$ | | —$CH_2$—OH |
| >NH | | —$CH_2$—O—R |
| | | —NH—$CH_2$—O—R |
| | | —NH—$CH_2$—OH |
| | | —N—($CH_2$—O—R)$_2$ |
| | | —NH—C(O)—CH(—C(O)OR)$_2$ |
| | | —NH—C(O)—CH(—C(O)OR)(—C(O)—R) |
| | | —NH—C(O)—NR'R" |
| | | >Si(OR)$_2$ |
| | | 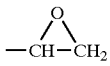 |
| | | 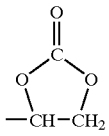 |
| —C(O)—OH | | 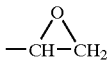 |
| | | —C(O)—N($CH_2$—$CH_2$—OH)$_2$ |
| —O—C(O)—$CR^5$=$CH_2$ | | —OH |
| —O—CR=$CH_2$ | | —$NH_2$ |
| | | —C(O)—$CH_2$—C(O)—R |
| | | —CH=$CH_2$ |
| >C=O | | —C(O)—NH—$NH_2$ |

The selection of the complementary reactive functional groups is guided by the temperature range within which full curing of the matrix of the films of the functional coating materials of the invention, including the binders (A), especially the polyurethanes (A), takes place. Accordingly, the thermal curing of the separate crosslinking system (B) must take place at relatively low temperatures if the functional coating materials of the invention comprise functional coating materials curable thermally or both thermally and with actinic radiation. The skilled worker will therefore easily be able to select, for a given functional coating material of the invention, the complementary reactive functional groups that are suitable in each case, on the basis of his or her general knowledge in the art, with the assistance of simple rangefinding tests where appropriate.

the German patent application DE 199 04 317 A1, page 3 line 64 to page 2 line 2 in conjunction with page 4 line 7 to page 9 line 43, and page 15 lines 33 to 39 in conjunction with page 16 lines 30 to 45, or the German patent application DE 198 18 735 A1, column 2 lines 21 to 46, column 3 to column 6 line 33, and column 6 line 55 to column 7 line 35.

Curing with actinic radiation takes place with the aid of reactive functional groups which contain at least one, especially one, bond which can be activated with actinic radiation.

In the context of the present invention, a bond which can be activated with actinic radiation is a bond which, when exposed to actinic radiation, becomes reactive and, with other activated bonds of its own kind, undergoes polymerization reactions and/or crosslinking reactions which proceed in accordance with free-radical and/or ionic mechanisms. Examples of suitable bonds are carbon-carbon single bonds or carbon-carbon, carbon-oxygen, carbon-nitrogen, carbon-phosphorus or carbon-silicon single bonds or double bonds. Of these, the carbon-carbon double bonds are especially advantageous and are therefore used with very particular preference in accordance with the invention. For the sake of brevity, they are referred to below as "double bonds".

Accordingly, the group preferred in accordance with the invention contains one double bond or two, three or four double bonds. Where more than one double bond is used, the double bonds may be conjugated. In accordance with the invention, however, it is of advantage if the double bonds are present in isolation, in particular each terminally, in the group in question here. It is of particular advantage in accordance with the invention to use two double bonds, especially one double bond.

Examples of suitable groups are (meth)acrylate, ethacrylate, crotonate, cinnamate, vinyl ether, vinyl ester, dicyclopentadienyl, norbornenyl, isoprenyl, isopropenyl, allyl or butenyl groups; dicyclopentadienyl ether, norbornenyl ether, isoprenyl ether, isopropenyl ether, allyl ether, or butenyl ether groups; or dicyclopentadienyl ester, norbornenyl ester, isoprenyl ester, isopropenyl ester, allyl ester, or butenyl ester groups, and especially acrylate groups.

Examples of suitable constituents for separate crosslinker systems (B) curable with actinic radiation are described in detail in the German patent application DE 197 36 083 A1, page 7 line 3 to page 8 line 38.

The selection of the separate crosslinking systems (B) curable with actinic radiation is guided in particular by the wavelength range within which the bonds which can be activated with actinic radiation are activated. This wavelength range should be situated outside the range used to cure the functional coating materials of the invention. For a given functional coating material of the invention curable with actinic radiation, therefore, the skilled worker will usually be able to select appropriate separate crosslinking systems (B) curable with actinic radiation, on the basis of his or her general knowledge in the art, with the assistance of simple rangefinding tests where appropriate.

Of the above-described separate crosslinking systems (B) used in accordance with the invention, particular advantage is possessed by those which are thermally crosslinkable by way of keto groups and hydrazide groups. They are therefore used with particular preference in accordance with the invention. As already mentioned, the aqueous functional coating materials are referred to as the functional coating materials of the invention.

The particularly preferred separate crosslinking system (B) is externally crosslinking or self-crosslinking.

The particularly preferred externally crosslinking separate crosslinking system (B) comprises at least one constituent (B1) containing on average per molecule at least two, preferably at least three, keto groups. Moreover, the particularly preferred externally crosslinking separate crosslinking system (B) comprises at least one constituent (B2) containing on average per molecule at least two hydrazide groups. Preferably, the particularly preferred, externally crosslinking, separate crosslinking system (B) comprises a constituent (B1) and a constituent (B2). The ratio of the two constituents (B1) and (B2) may vary very widely and is guided by the functionality of the two complementary constituents.

Preferably, constituent (B1) is selected from the group consisting of oligomers and polymers containing terminal or lateral, or terminal and lateral, keto groups. Suitable oligomers and polymers come from the polymer classes described above in connection with the binders (A), with (meth) acrylate copolymers (B1) being particularly advantageous and therefore used with particular preference.

The constituents (B2) are preferably selected from the group consisting of low molecular mass compounds containing at least two hydrazide groups, and also oligomers and polymers containing terminal or lateral, or terminal and lateral, hydrazide groups. Suitable oligomers and polymers come from the polymer classes described below. Preferably, the low molecular mass compounds containing per molecule two hydrazide groups are used.

Examples of suitable low molecular mass compounds containing two hydrazide groups are the dihydrazides of organic dicarboxylic acids, such as phthalic acid, terephthalic acid, naphthalenedicarboxylic acid, 1,2-, 1,3- or 1,4-cyclohexanedicarboxylic acid, sebacic acid or adipic acid. Particular preference is given to using adipic dihydrazide.

In another preferred embodiment, the particularly preferred, self-crosslinking, separate crosslinking systems (B) comprise at least one constituent (B3) selected from the group consisting of oligomers and polymers containing on average per molecule at least two, in particular at least three, terminal or lateral, or terminal and lateral, keto groups and at least two, in particular at least three, terminal or lateral, or terminal and lateral, hydrazide groups, or consist of said constituent (B3).

Apart from the keto groups, the preferred separate crosslinking systems (B) may further include at least one of the above-described complementary reactive functional groups for thermal crosslinking and/or at least one of the above-described reactive functional groups containing at least one bond which can be activated with actinic radiation. These reactive functional groups may then serve for crosslinking of said crosslinking systems (B) with the matrix of the films of the functional coating materials of the invention.

The particularly preferred separate crosslinking systems (B) which are able to crosslink by way of keto groups and hydrazide groups are commercially customary substances and are sold, for example, in the form of aqueous dispersions under the brand name Acronal®, especially Acronal® A 603 or A 627, or under the brand name Luhydran®, especially Luhydran® LR 8950 or 8975, by BASF Aktiengesellschaft, under the brand name by Viacryl®, especially Viacryl® VSC 6270, 6286 or 6295, by Solutia, or under the brand name Setalux®, especially Setalux® 6810 AQ-25 or XL 1141, by Akzo. The aqueous dispersions are crosslinked in particular using adipic dihydrazide. In general, the adipic dihydrazide content of the aqueous dispersions is up to 10% by weight, based on the solids content of the aqueous dispersions.

The amount of the separate crosslinking systems (B) in the functional coating materials of the invention may vary very widely and is guided by the requirements of the individual case. Preferably, based in each case on the solids, the functional coating materials of the invention contain from 1 to 50, more preferably from 2 to 48, with particular preference from 3 to 44, with very particular preference from 4 to 42, and in particular from 5 to 40, % by weight of (B).

The functional coating materials of the invention comprise at least one pigment (C).

The pigments (C) are preferably selected from the group consisting of color and/or effect pigments, fluorescent pigments, electrically conductive pigments, and magnetically shielding pigments, metal powders, organic and inorganic, transparent and opaque fillers, and nanoparticles.

The amounts of the pigments (C) in the functional coating materials of the invention may vary very widely. The amount is preferably chosen so that the proportion of pigments (C) to binders (A) and to the oligomers and polymers that may be present in the separate crosslinking systems (B) (pigment:binder ratio) is from 0.1:1 to 3:1, more preferably from 0.2:1 to 2.8:1, with particular preference from 0.3:1 to 2.5:1, with very particular preference from 0.3:1 to 2:1, and in particular from 0.3:1 to 1.5:1.

Examples of suitable effect pigments are metal flake pigments such as commercially customary aluminum bronzes, aluminum bronzes chromated as per DE 36 36 183 A1, and commercially customary stainless steel bronzes, and also nonmetallic effect pigments, such as pearlescent pigments and interference pigments, for example, platelet-shaped effect pigments based on iron oxide with a shade from pink to brownish red, or liquid-crystalline effect pigments. For further details, refer to Römpp Lexikon Lacke und Druckfarben, Georg Thieme Verlag, 1998, page 176, "effect pigments" and pages 380 and 381, "metal oxide/mica pigments" to "metal pigments", and to the patent applications and patents DE 36 36 156 A1, DE 37 18 446 A1, DE 37 19 804 A1, DE 39 30 601 A1, EP 0 068 311 A1, EP 0 264 843 A1, EP 0 265 820 A1, EP 0 283 852 A1, EP 0 293 746 A1, EP 0 417 567 A1, U.S. Pat. No. 4,828,826 A, and U.S. Pat. No. 5,244,649 A.

Examples of suitable inorganic color pigments are white pigments such as titanium dioxide, zinc white, zinc sulfide or lithopones; black pigments such as carbon black, iron manganese black or spinel black; chromatic pigments such as chromium oxide, chromium oxide hydrate green, cobalt green or ultramarine green, cobalt blue, ultramarine blue or manganese blue, ultramarine violet or cobalt and manganese violet, red iron oxide, cadmium sulfoselenide, molybdate red or ultramarine red; brown iron oxide, mixed brown, spinel phases and corundum phases or chrome orange; or yellow iron oxide, nickel titanium yellow, chrome titanium yellow, cadmium sulfide, cadmium zinc sulfide, chrome yellow or bismuth vanadate.

Examples of suitable organic color pigments are monoazo pigments, disazo pigments, anthraquinone pigments, benzimidazole pigments, quinacridone pigments, quinophthalone pigments, diketopyrrolopyrrole pigments, dioxazine pigments, indanthrone pigments, isoindoline pigments, isoindolinone pigments, azomethine pigments, thioindigo pigments, metal complex pigments, perinone pigments, perylene pigments, phthalocyanine pigments, or aniline black.

For further details, refer to Römpp Lexikon Lacke und Druckfarben, Georg Thieme Verlag, 1998, pages 180 and 181, "iron blue pigments" to "black iron oxide", pages 451 to 453, "pigments" to "pigment volume concentration", page 563, "thioindigo pigments", page 567, "titanium dioxide pigments", pages 400 and 467, "naturally occurring pigments", page 459, "polycyclic pigments", page 52, "azomethine pigments", "azo pigments", and page 379, "metal complex pigments".

Examples of fluorescent pigments (daylight-fluorescent pigments) are bis(azomethine) pigments.

Examples of suitable electrically conductive pigments are titanium dioxide/tin oxide pigments.

Examples of magnetically shielding pigments are pigments based on iron oxides or chromium dioxide.

Examples of suitable metal powders are powders of metals and metal alloys comprising aluminum, zinc, copper, bronze or brass.

Examples of suitable organic and inorganic fillers are chalk, calcium sulfates, barium sulfate, silicates such as talc, mica or kaolin, silicas, oxides such as aluminum hydroxide or magnesium hydroxide, or organic fillers such as polymer powders, especially those of polyamide or polyacrylonitrile. For further details, refer to Römpp Lexikon Lacke und Druckfarben, Georg Thieme Verlag, 1998, pages 250 ff., "fillers".

It is preferred to employ mica and talc when the intention is to enhance the scratch resistance of the coatings produced from the coating materials of the invention.

Furthermore, it is of advantage to use mixtures of platelet-shaped inorganic fillers such as talc or mica and non-platelet-shaped inorganic fillers such as chalk, dolomite, calcium sulfates or barium sulfate, since by this means the viscosity and rheology may be adjusted very effectively.

Examples of suitable transparent fillers are those based on silica, alumina or zirconium oxide.

Suitable nanoparticles are selected from the group consisting of hydrophilic and hydrophobic, especially hydrophilic, nanoparticles based on silica, alumina, zinc oxide, zirconium oxide, and the polyacids and heteropolyacids of transition metals, preferably of molybdenum and tungsten, having a primary particle size <50 nm, preferably from 5 to 50 nm, in particular from 10 to 30 nm. Preferably, the hydrophilic nanoparticles have no flatting effect. Particular preference is given to using nanoparticles based on silica.

Very particular preference is given to using hydrophilic pyrogenic silicas, whose agglomerates and aggregates have a catenated structure and which can be prepared by the flame hydrolysis of silicon tetrachloride in an oxyhydrogen flame. They are sold, for example, by Degussa under the brand name Aerosil®. Very particular preference is also given to using precipitated waterglasses, such as nanohectorites, which are sold, for example, by Sudchemie under the brand name Optigel® or by Laporte under the brand name Laponite®.

Additionally, the functional coating materials of the invention may further comprise at least one additive (D) as commonly used in the field of functional coating materials.

Examples of suitable additives are molecularly dispersely soluble dyes; light stabilizers, such as UV absorbers and reversible free-radical scavengers (HALS); antioxidants; low- and high-boiling ("long") organic solvents; devolatilizers; wetting agents; emulsifiers; slip additives; polymerization inhibitors; crosslinking catalysts; thermolabile free-radical initiators; reactive diluents curable thermally and with actinic radiation; adhesion promoters; leveling agents; film formation auxiliaries; rheology assistants (thickeners); flame retardants; corrosion inhibitors; waxes; siccatives; biocides and/or flatting agents, as they are described in detail, for example, in the textbook "Lackadditive" [Additives for Coatings] by Johan Bieleman, Wiley-VCH, Weinheim, N.Y., 1998, or in the German patent application DE 199 14 896 A1, column 14 line 26 to column 15 line 46.

In terms of its method, the preparation of the functional coating materials of the invention has no special features but instead takes place by mixing of the above-described constituents in customary and known mixing apparatus, such as stirred tanks, Ultraturrax, inline dissolvers, extruders or compounders.

In terms of its method, the application of the functional coating materials of the invention also has no special features but may instead take place by any customary application method, such as spraying, knife coating, brushing, flow coating, dipping, trickling or rolling, for example. It is preferred to use spray application methods, such as compressed air spraying, airless spraying, high-speed rotating, electrostatic spray application (ESTA), alone or in conjunction with hot spray application such as hot air spraying, for example. These application methods may of course also be used for applying the solid-color topcoat materials, the aqueous basecoat materials, and also the clearcoat materials.

Following application, the films of the functional coating materials of the invention are dried without being fully cured. It is preferred in this case to employ temperatures from 20 to 80, more preferably from 20 to 70, and in particular from 20 to 65° C. Drying may be assisted by means of laminar air flows. It is preferred to employ drying times of from 30 seconds to two hours, preferably from one minute to one hour, and in particular from one minute to 45 minutes.

In accordance with the invention, during this step of the process, the separate, water-soluble and/or -dispersible crosslinking system (B) crosslinks on and/or in the matrix of the wet, drying and/or dried films, partly or completely, before the binders (A) crosslink completely. Where the separate crosslinking systems (B) are also or exclusively curable with actinic radiation, the films are exposed to actinic radiation.

For actinic radiation exposure, suitable radiation sources include those such as high-pressure or low-pressure mercury vapor lamps, which may be doped with lead in order to open up a radiation window of up to 405 nm, or electron beam sources. Further examples of suitable methods and apparatus for curing with actinic radiation are described in the German patent application DE 198 18 735 A1, column 10 lines 31 to 61.

In the further course of the process of the invention, the dried film of the functional coating material of the invention is coated with at least one, especially one, aqueous solid-color topcoat material to give a solid-color topcoat film. This may be done using the application methods described above. Examples of suitable aqueous solid-color topcoat materials are described in the patent applications cited at the outset, particularly in the German patent application DE 199 14 896 A1, column 1 lines 29 to 49. Thereafter, the solid-color topcoat film and the dried film, and also, where present, the dried electrocoat film, are cured together physically, thermally, or both thermally and with actinic radiation, particularly thermally or both thermally and with actinic radiation. This is done using the curing methods described above. Curing thermally may be done in customary and known forced air ovens or using IR lamps. The result is therefore a multicoat system of the invention which comprises at least one, especially one, functional coat and at least one, especially one, solid-color and/or effect topcoat.

As an alternative to this, in the further course of the process of the invention, the dried film is coated with at least one, especially one, aqueous basecoat material to give an aqueous basecoat film. Examples of suitable aqueous basecoat materials are described in the patent applications cited at the outset, in particular in the German patent application DE 199 14 896 A1, column 1 lines 29 to 49. The aqueous basecoat film is subsequently dried without being fully cured. This may be done using the drying methods described above.

In the further course of the process of the invention, at least one, especially one, clearcoat material is applied to the dried aqueous basecoat film to give a clearcoat film. Examples of suitable clearcoat materials are described in the patent applications specified at the outset, in particular in the German patent application DE 199 14 896 A1, column 17 line 57 to column 18 line 30. Where they are not powder coating materials, the application methods described above may be employed. Examples of suitable application methods for powder coating materials are described, for example, in the Lacke + Farben AG product information bulletin "Pulverlacke" [Powder coating materials], 1990.

Consequently, the dried film of the functional coating material of the invention, the aqueous basecoat film, and the clearcoat film, and also, where present, the electrocoat film, are cured, preferably thermally or both thermally and with actinic radiation, it being possible to use the methods and apparatus described above. The result is a multicoat color and/or effect coating system of the invention which comprises at least one functional coat, at least one color and/or effect aqueous basecoat, and at least one clearcoat.

In a further variant of the process of the invention, the dried film of the functional coating material of the invention and the aqueous basecoat film are cured together. Subsequently, at least one clearcoat material is applied to the resulting aqueous basecoat, after which the resulting clearcoat film(s) is(are) cured, it being possible to employ the methods and apparatus described above. Here again, the result is a multicoat color and/or effect coating system of the invention, having the structure described above.

The multicoat color and/or effect coating systems of the invention produced with the aid of the process of the invention exhibit excellent leveling, a uniformly smooth surface, a high level of intercoat adhesion, and outstanding appearance properties. As compared with multicoat color and/or effect coating systems having no functional coat in the sense of the present invention but instead only a baking primer-surfacer coat, little if any shifts in effect and/or shade occur when using the same aqueous basecoat material.

INVENTIVE AND COMPARATIVE EXAMPLES

Preparation Example 1

The Preparation of an Aqueous Dispersion Comprising a Polyurethane (A)

For the inventive and comparative examples, the aqueous dispersion of a polyurethane (A) was prepared in accordance with the instructions given in the German patent application DE 44 38 504 A1, page 5, lines 24 to 42, "1. Preparation of water-dilutable polyurethane resins; 1.1 Polyurethane resin".

Inventive Examples 1 and 2 and Comparative Example C1

The Preparation of the Functional Coating Materials 1 and 2 of the Invention (Inventive Examples 1 and 2) and of the Noninventive Functional Coating Material C1 (Comparative Example C1)

The inventive functional coating materials 1 and 2 and the noninventive functional coating material C1 were prepared by mixing the constituents indicated in Table 1 in the sequence stated, and homogenizing the mixture.

TABLE 1

The composition of the inventive functional coating materials 1 and 2 (Inventive Examples 1 and 2) and of the noninventive functional coating material C1 (Comparative Example C1)

| | Examples: | | |
|---|---|---|---|
| Constituents | 1 | 2 | C1 |
| Pigment paste: | | | |
| Polyurethane dispersion from Preparation Example 1 | 32.1 | 32.1 | 32.1 |
| Additol ® XW 395 (commercial leveling agent from Solutia) | 0.48 | 0.48 | 0.48 |
| Tensid S (commercial wetting agent from BASF Aktiengesellschaft) | 0.5 | 0.5 | 0.5 |
| Aerosil ® R 972 (commercial pyrogenic silica from Degussa) | 0.34 | 0.34 | 0.34 |

TABLE 1-continued

The composition of the inventive functional coating materials 1 and 2 (Inventive Examples 1 and 2) and of the noninventive functional coating material C1 (Comparative Example C1)

| Constituents | Examples: 1 | 2 | C1 |
|---|---|---|---|
| Aerosil ® R 805 (commercial pyrogenic silica from Degussa) | 1.02 | 1.02 | 1.02 |
| Deionized water | 1.45 | 1.45 | 1.45 |
| Flammruβ 101 (commercial carbon black from Degussa) | 0.9 | 0.9 | 0.9 |
| Sicomix-Schwarz 00-6190 (commercial black pigment from Degussa) | 2.4 | 2.4 | 2.4 |
| Talkum 10 MO Micro (commercial talc filler from Luzenac de France) | 3.6 | 3.6 | 3.6 |
| Titan Rutil R 900-28 (commercial rutile titanium dioxide pigment from DuPont) | 0.76 | 0.76 | 0.76 |
| Aluminiumsilikat ASP 200 (commercial aluminum silicate filler from Engelhard) | 5.8 | 5.8 | 5.8 |
| Deionized water | 1.4 | 1.4 | 1.4 |
| Deionized water | 1.3 | 1.3 | 1.3 |
| Make-up: | | | |
| Viacryl ® VSC 6295 (commercial aqueous dispersion of a methacrylate copolymer crosslinkable with adipic dihydrazide; manufacturer: Solutia) | 9.9 | 19.8 | — |
| Polyurethane dispersion from Preparation Example 1 | 16.5 | — | 32.1 |
| Cymel ® 1133 (commercial melamine resin from Dyno-Cytec) | 0.9 | 0.9 | 0.9 |
| Pluriol ® P900 (commercial polyether polyol from BASF Aktiengesellschaft) | 0.8 | 0.8 | 0.8 |
| Byk ® 346 (commercial silicone surfactant from Byk Chemie) | 0.4 | 0.4 | 0.4 |
| Byketol ® WS (commercial additive from Byk Chemie) | 0.8 | 0.8 | 0.8 |
| Serad ® FX 1010 (commercial rheology assistant from Servo Delden) | 10 | 10 | 10 |
| Deionized water | 9.1 | 15.25 | 2.95 |
| Solids content: | 35.84 | 35.86 | 35.81 |
| Pigment/binder ratio: | 0.64 | 0.5 | 0.89 |

Inventive Examples 3 and 4 and Comparative Examples C2 and C3

The Preparation of Inventive Multicoat Systems (Inventive Examples 3 and 4) and of a Noninventive Multicoat System (Comparative Example C2)

The functional coating material of Inventive Example 1 was used for Inventive Example 3, and the functional coating material of Inventive Example 2 was used for Inventive Example 4.

The functional coating material of Comparative Example C1 was used for Comparative Example C2.

To produce the multicoat systems, steel panels were coated with a customary and known, cathodically deposited electrocoat. A commercial primer-surfacer (Ecoprime® 130 from BASF Coatings AG) was applied pneumatically to the electrocoat and then baked at 130° C. for 30 minutes to give a primer-surfacer coat.

Half of the coated surface of the steel panels was coated with the functional coating materials of the Inventive Examples 1 and 2 (Inventive Examples 3 and 4) and of the Comparative Example C1 (Comparative Example C2), so that always half of the conventional primer-surfacer coat remained visible. The resulting films of the functional coating materials of Inventive Examples 1 and 2 and of Comparative Example C1 were dried at 60° C. for 10 minutes.

Subsequently, the entire coated surfaces of the steel panels were coated with a commercially customary aqueous basecoat material—shade brilliant silver—from BASF Coatings AG and dried at 60° C. for 10 minutes. Thereafter, the two films were baked in a forced air oven at 130° C. for 30 minutes.

The resulting inventive multicoat systems of Inventive Examples 3 and 4 and also the resulting noninventive multicoat system of Comparative Example C2 were compared directly calorimetrically using the "baked Ecoprime® 130/aqueous basecoat" system as a standard. In the case of the inventive multicoat system of Inventive Example 3, the shade shift D was only 2.9, and in the case of the inventive multicoat system of Inventive Example 4 the shade shift D was only 1.5, whereas the noninventive multicoat system of Comparative Example C2 showed a shade shift D of 6.3.

What is claimed is:

1. An aqueous functional coating material comprising (A) at least one binder, (B) at least one separate crosslinking system, wherein the crosslinking system is at least one of water-soluble and water-dispersible, wherein the crosslinking system independently effects at least partial crosslinking in and/or on a film formed from the aqueous coating material before the at least one binder crosslinks completely, wherein the film is wet, drying, or dried, and (C) at least one pigment.

2. The coating material of claim 1, wherein the at least one binder is selected from the group consisting of ionically stabilized polyurethanes, nonionically stabilized polyurethanes, and ionically and nonionically stabilized polyurethanes, wherein the polyurethanes are saturated or unsaturated, and wherein the polyurethanes are optionally grafted with olefinically unsaturated compounds.

3. The coating material of claim 1, wherein the crosslinking system (B) is curable by one of physically, thermally, with aclinic radiation, and both thermally and with actinic radiation.

4. The coating material of claim 1, wherein the crosslinking system (B) is curable thermally or both thermally and with actinic radiation.

5. The coating material of claim 1, wherein the crosslinking system is selected from the group consisting of thermally externally crosslinking and self-crosslinking systems.

6. The coating material of claim 1, wherein the crosslinking system comprises at least one of (i) at least one constituent containing on average per molecule at least two koto groups, and at least one constituent containing on average per molecule at least two hydrazide groups, and (ii) at least one constituent containing on average per molecule at least two keto groups and at least two hydrazide groups.

7. The coating material of claim 1, wherein the at least one pigment is selected from the group consisting of color and/or effect pigments, fluorescent pigments, electrically conductive pigments, magnetically shielding pigments, metal powders, organic fillers, inorganic fillers, transparent fillers, opaque fillers, nanoparticles, and combinations thereof.

8. The coating material of claim 1, wherein a proportion of the at least one pigment to a combined amount of the at least one binder and the crosslinking system (pigment:binder ratio) is from 0.1:1 to 3:1.

9. A wet-on-wet process for producing a multicoat color and/or effect coating system comprising (1) applying the aqueous functional coating material of claim 1 to a primed or unprimed substrate and forming a functional film, (2) drying the functional film without fully curing, and one or I) (I3) coating the dried functional film with an aqueous solid-color topcoat material and forming a topcoat film, and (I4) curing the functional film and the topcoat film together to give a functional coat and a solid-color topcoat; or II)(II3) coating the dried functional film with an aqueous basecoat material and forming a basecoat film, (II4) coating the basecoat film with a clearcoat material and forming a clearcoat film, and (II5) curing the functional film, the basecoat film, and the clearcoat film together to give a functional coat, a basecoat, and a clearcoat; or III) (III3) coating the dried functional film with an aqueous basecoat material and forming a basecoat film, (III4) curing the basecoat film and the dried functional film together to give a functional coat and a basecoat, and (III5) coating the basecoat with a clearcoat material and forming a clearcoat film, and (III6) curing the clearcoat film to give a clearcoat.

10. The process of claim 9, wherein the at least one crosslinkable binder is selected from the group consisting of ionically stabilized polyurethanes nonionically stabilized polyurethanes and ionically and nonionically stabilized polyurethanes, wherein the polyurethanes are saturated or unsaturated, and wherein the polyurethanes are optionally grafted with olefinically unsaturated compounds.

11. The process of claim 9, wherein the crosslinking system (B) is curable by one of physically, thermally, with aclinic radiation, and both thermally and with actinic radiation.

12. The process of claim 9, wherein the crosslinking system (B) is curable thermally or both thermally and with actinic radiation.

13. The process of claim 9, wherein the crosslinking system is selected from the group consisting of thermally externally crosslinking end self-crosslinking systems.

14. The process of claim 9, wherein the crosslinking system is crosslinked thermally, and the crosslinking system contains at least one of i) at least two keto groups and ii) at least two hydrazide groups.

15. The process of claim 9, wherein the at least one pigment is selected from the group consisting of color and/or effect pigments, fluorescent pigments, electrically conductive pigments, magnetically shielding pigments, metal powders, organic fillers, inorganic fillers, transparent fillers, opaque fillers, nanoparticles, and combinations thereof.

16. The process of claim 9, wherein a primer on the substrate is prepared by applying an electrocoat material to the substrate and forming an electrocoat film, and one of I) overcoating the electrocoat film with the aqueous functional coating material and the solid-color topcoat material without fully curing each, or ii) overcoating the electrocoat film with the aqueous functional coating material, the aqueous basecoat material, and the clearcoat material, wherein one of i) all films are cured together, or ii) the electrocoat film, the functional film, and the basecoat film are cured together and the clearcoat film is cured separately.

17. The process of claim 9, wherein the aqueous functional coating material is the material for at least one of a primer-surface coat, an antistoneship primer coat, the solid-color topcoat, and the basecoat in the coating system.

* * * * *